US005083846A

United States Patent [19]

Day, Jr. et al.

[11] Patent Number: 5,083,846

[45] Date of Patent: Jan. 28, 1992

[54] DOOR PANEL FOR MULTIPLE PRODUCT FUEL DISPENSERS

[75] Inventors: Robert T. Day, Jr., Randleman; Leon B. Smith, Greensboro, both of N.C.

[73] Assignee: Gilbarco, Inc., Greensboro, N.C.

[21] Appl. No.: 507,364

[22] Filed: Apr. 10, 1990

[51] Int. Cl.[5] ..... A47B 88/00

[52] U.S. Cl. ..... 312/321.5; 222/74

[58] Field of Search ..... 222/14–23, 222/25–27, 32–35, 71–75; 312/321.5

[56] References Cited

U.S. PATENT DOCUMENTS

| | | | |
|---|---|---|---|
| 3,489,316 | 1/1970 | Velvin | 222/19 |
| 3,531,172 | 9/1970 | Schnarr | 312/321.5 |
| 4,331,190 | 5/1982 | Sutcliffe et al. | 222/75 |
| 4,576,312 | 3/1986 | Swick, Jr. | 222/27 |
| 4,611,729 | 9/1986 | Gerstenmaier et al. | 222/75 |
| 4,921,315 | 5/1990 | Metcalfe et al. | 312/321.5 |

*Primary Examiner*—Michael S. Huppert

*Assistant Examiner*—Shari Wunsch

*Attorney, Agent, or Firm*—Rhodes, Coats & Bennett

[57] ABSTRACT

In a unitized door construction for fuel dispensers, a molded door panel hinged at one edge to selectively provide access to the safe zone in which are housed all electronics, lamps, one or more customer communication devices, and, in some embodiments, even meter encoders and/or the electromechanical portion of the fuel valves. The nozzle boot(s) and nozzle cradle seat(s) are molded integrally into the surface of the door panel. One or more smaller access panels in the upper portion of the door panel allow separate and selective access through the larger door panel to the credit card reader, receipt printer, cash depository, and attendant key pad, as well as providing security for the large door panel. A unique hinge arrangement allows the hinge to be located internally of the external periphery of the door panel and then the door to be moved rearwardly upon closure to effect the final sealing thereof.

24 Claims, 4 Drawing Sheets

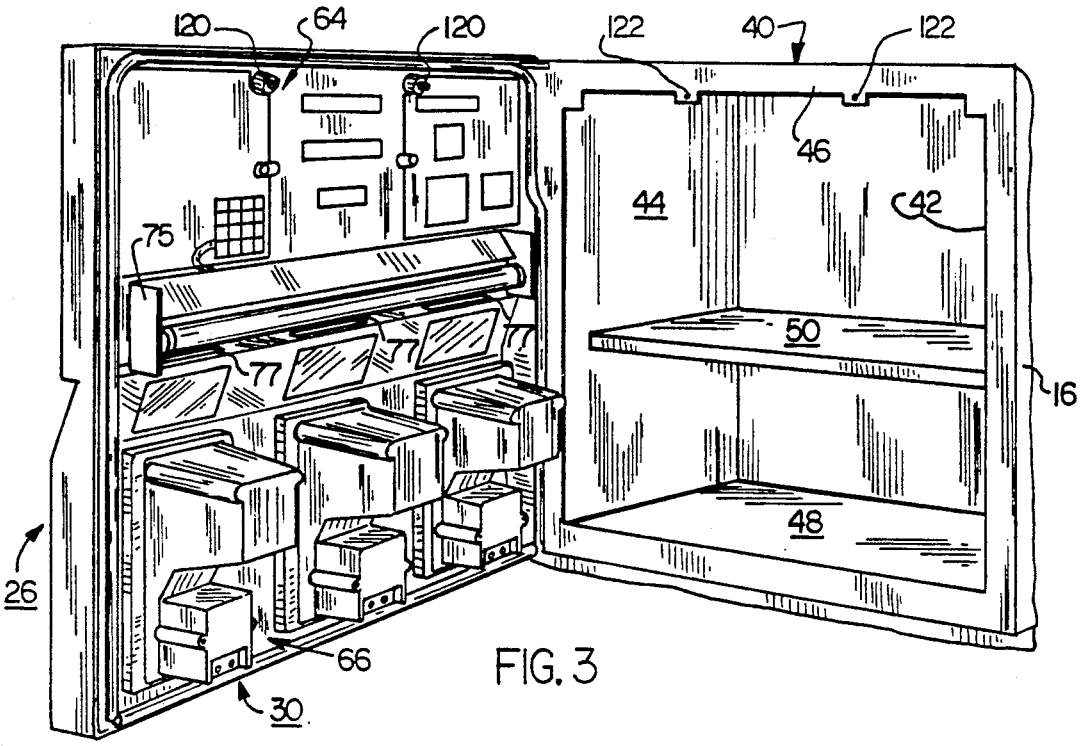
FIG. 3
FIG. 4
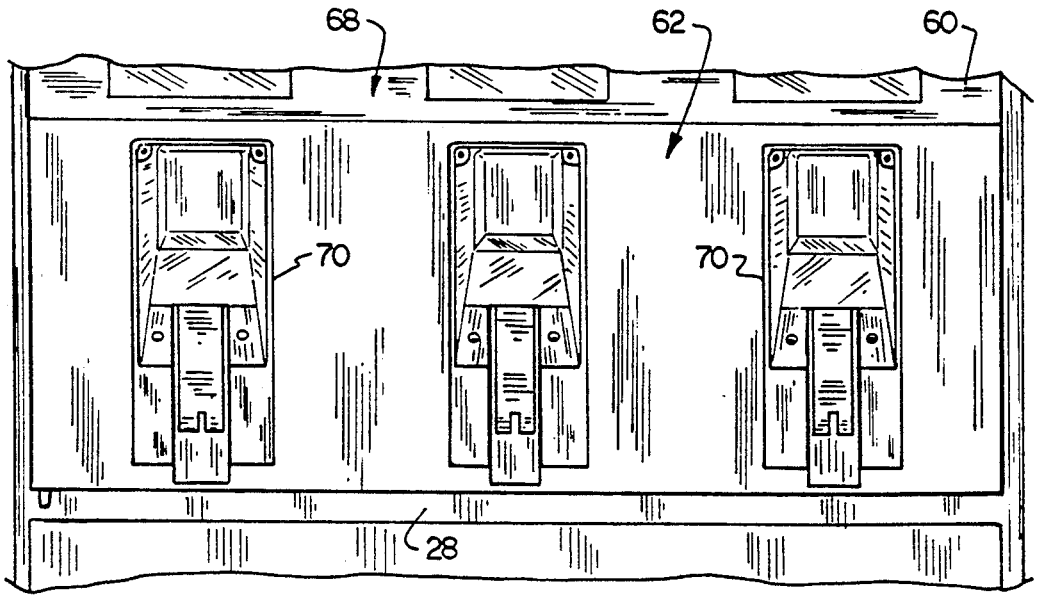

DOOR PANEL FOR MULTIPLE PRODUCT FUEL DISPENSERS

BACKGROUND AND SUMMARY OF THE PRESENT INVENTION

The present invention is directed to fuel dispensers and more particularly, to a multiple product fuel dispenser that includes a formed door panel on each side thereof, the periphery of which covers the entire safe zone of the fuel dispenser and the face of which has the nozzle boot(s) molded thereinto.

For years gasoline has been dispensed through pumps. Initially, pumps were designed to dispense one type of gasoline therefrom. In more recent years, a new type of gasoline dispensing unit, referred to as a multiple product fuel dispenser, has become prevalent. In a multiple product fuel dispenser, a single housing is used to house several pumps and nozzles, so that various types of gasoline may be dispensed to one or more automobiles parked on either side of the dispenser, no matter which type of gasoline is desired.

The lower portion of a conventional fuel dispenser generally houses several pumps or flow control valves, each of which delivers a prescribed type of gasoline from underground tanks to a fuel dispensing nozzle. The multiple fuel dispenser contains a plurality of nozzles, each connected to one of the pumps for dispensing fuel delivered thereto. Most dispensing units have opposed sides or faces with the nozzles duplicated thereon. Thus a single pump or flow control valve in the lower portion may deliver gasoline to a pair of nozzles, one mounted on each side of the fuel dispenser. When not in use, the nozzles are seated on a nozzle cradle with the nozzle spout received within nozzle boots which serve not only to store the nozzles but also provide a shroud to protect the nozzle spout against the entry of dirt or moisture. The nozzle boots are conventionally fabricated separately as cast metallic structures which are attached to the housing for the lower portion of the fuel dispenser.

A second upper area of the fuel dispensing housing contains the electronics of the system. In the upper area are mounted such customer communication devices as fuel and price indicators, receipt printers, credit card readers, cash note acceptor and storage units, operator key pads and the like. The electronics area is generally isolated from the pump area, because of the dangerous vapors which exist in the pump area. The pump area has become known as the "hazardous zone" while the electronics area has been defined as the "safe zone". Some electronic devices have, in the past, been housed in the hazardous zone. Such devices include the pump motors, solenoids for valves, and other electromechanical devices. When housed in the hazardous area, extreme care has been found necessary that the individual electromechanical devices are enclosed in explosion-proof housings or isolated through the use of intrinsically safe circuitry in order to protect against the hazards of a spark igniting fuel vapors.

The aforementioned electronics have generally been contained in the upper portion or safe zone. The upper portion has been covered by a plurality of removable covers, doors, and/or electronics which are individually bolted or otherwise secured to the frame of the fuel dispenser island. The aforementioned nozzle boots and cradles have conventionally been mounted in front of the hazardous zone. Again the nozzle boots have been in the form of separate metallic castings which are secured to support panels which, in turn, are mounted to the frame of the fuel dispenser housing. Access in general to the electronics has been difficult because of the necessity to first remove a plurality of exterior panels.

An example of such a type of fuel dispenser is illustrated and described in U.S. Pat. No. 4,576,312 to Swick, Jr. In the Swick patent, it can be seen that the nozzle boots are provided in shrouds which are mounted atop the hazardous zone. The electronics portion is housed within housing 30, and must be substantially disassembled in order to gain access for maintenance, repair, and servicing. As can be seen, the electronics portion is extremely inaccesible to an operator or maintenance personnel.

In applicant's copending application Ser. No. 07/445,466 filed Dec. 4, 1989 and entitled "Gasoline Dispenser with Valve Control Through an Air Gap", there is disclosed a multiple product fuel dispenser for a plurality of nozzles in which a plurality of pumps are housed in a hazardous zone. All of the electronics are housed in an area above the hazardous zone known as the "safe zone", and an air gap provides a vapor barrier to safeguard against electrical addition of gasoline vapors.

Various problems have existed with the above configurations. First of all, the separate fabrication of cover panels, nozzle boots, nozzle cradle seats, and the like is expensive. Conventionally, some of these components are sheet metal which are fabricated to the proper size. Other of the units such as the nozzle boots and cradles are cast from aluminum or zinc, then assembled onto the dispenser island frame.

A second problem arises as a result of the assembly of so many components onto a support frame or superstructure. Such assembly operations require a more complicated supporting frame with cross members extending vertically and horizontally. Mounting flanges must also be provided on each separate component through which screws or like fasteners can extend into the frame members and cross members. As a result, the usable space on the face of the panel covering the safe zone is extremely limited.

Because of a desire on the part of the industry to limit access to the operator as much as possible, the industry now is desirous of a multiple product fuel dispenser which is substantially self-contained. That is, in addition to merely having fuel dispensers, the unit contains a credit card reader, a receipt printer, and even a cash receipt and storage device, as well as conventional customer communication devices such as fuel type and price indicators and lamps. Therefore, space on the cover member(s) of the safe zone is at a premium. Also, along the same line, where the nozzle boots and nozzle cradles are securely attached to the dispenser frame itself, the area therebehind is essentially inaccessible for the location of electronic equipment, because access thereto for the purposes of maintenance is difficult.

Access is also difficult to the other types of electronic equipment in conventional multiple product fuel dispensers because all the electronics is behind panels which are secured in some manner to the dispenser frame. Another problem existent with the assembly of so many individual components onto the fuel dispenser frame is that each item which is secured must be sealed, as the atmosphere within the safe zone must be individually sealed from the atmosphere to protect the sensitive electronics therein.

SUMMARY OF THE PRESENT INVENTION

In an effort to address the problems set forth hereinabove, and in its most general sense, the present invention is directed to a new unitized door construction for fuel dispenser housings of the type in which a single frame houses an enclosure in which are mounted several pumps or flow control valves and as many as eight nozzles, arranged four on each side. Thus, the same dispenser unit can serve separate automobiles on each side, and the operator of each automobile can select fuel from up to four storage tanks. The aforementioned approach is not unique in and of itself, since such clusters of nozzles and pumps have been used in the past. However, in the fuel dispenser of the present invention, the safe zone which includes the electronics, lamps, customer communication devices, and in some embodiments, even meter encoders and/or the electromechanical portion of the fuel valves is covered by an access door which includes a door panel, nozzle boot, and nozzle cradle seat all formed together in a "unitized" construction. The heart of the aforementioned unitized access door resides in a main body panel of such dimensions as to extend around the complete periphery of the safe zone. The door panel is preferably molded of a tough structural polymeric material. The term "unitized" construction means that the main body panel, the nozzle boots, and the nozzle cradles are all formed as a unit, then hingedly connected to the dispenser frame. Thus formed and assembled, the door swings outwardly to provide complete access, upon a single opening, to all of the electronics, the customer communication components and the other components within the safe zone. The access door is preferably hinged at one side, so that maintenance personnel can more easily have access to the components therebehind.

The nozzle boot and nozzle cradle seat are formed into the front surface of the aforesaid door panel, rather than being fabricated separately and attached thereto. The door panel also includes one or more openings behind which the main dispenser display is attached and through which indicator lights provide visual indications to the customer. A light trough houses a fluorescent tube and the door panel includes a slotted portion through which the light from the fluorescent tube shines upon the brand name displays. A pair of small access panels are hingedly mounted to the upper portion of the unitized door panel to provide access to such customer communication devices credit card reader, cash receipt and storage device, and the operator key pad. The small access panels are locked and require the proper key to gain access to the upper fastening members for the large door panel, which thereby provides security therefor. The large door panel cannot be opened until the smaller access doors have been unlocked and opened which provides access to the fastening pins or bolts.

Finally, a seal extends around the periphery of the door panel, which the door is so hinged that, after it swings to a position approximating the closed position, fastening pins or bolts are secured to move the door panel rearwardly into sealing engagement with the dispenser housing. Thus the closure movement is a compound motion including a swinging movement and a front to rear linear movement to effect a final seal. A separate door panel is provided for each side of the safe zone. Access to the cash receipt storage box on one side of the dispenser is obtained by opening the small access door at the corresponding portion of the door panel on the opposite side.

It is therefore an object of the present invention to provide an improved, economical construction for multiple product fuel dispenser housings.

It is another object of the present invention to provide improved housings of the type described which include a unitized door construction.

It is yet another object of the present invention to provide a unitized construction of the type described in which the access door preferably is formed of a molded polymeric panel having the nozzle boot and nozzle cradle seat molded into the surface thereof.

Yet another object of the present invention is to provide a fuel dispenser housing of the type described in which access to all of the electrical devices and customer communication components in the safe zone is obtained by the opening of a single unitized access door.

Other objects and a fuller understanding of the invention will become apparent from reading the following detailed description of a preferred embodiment, along with the accompanying drawings in which:

FIG. 3 is a perspective view similar to FIG. 2, except looking from the opposite side, and illustrating the large unitized access door of the present invention in an open condition;

FIG. 4 is a front elevation view of the access door of FIGS. 1 and 2 with the nozzles removed;

DETAILED DESCRIPTION OF THE PREFERRED EMBODIMENT OF THE INVENTION

Figure 1:
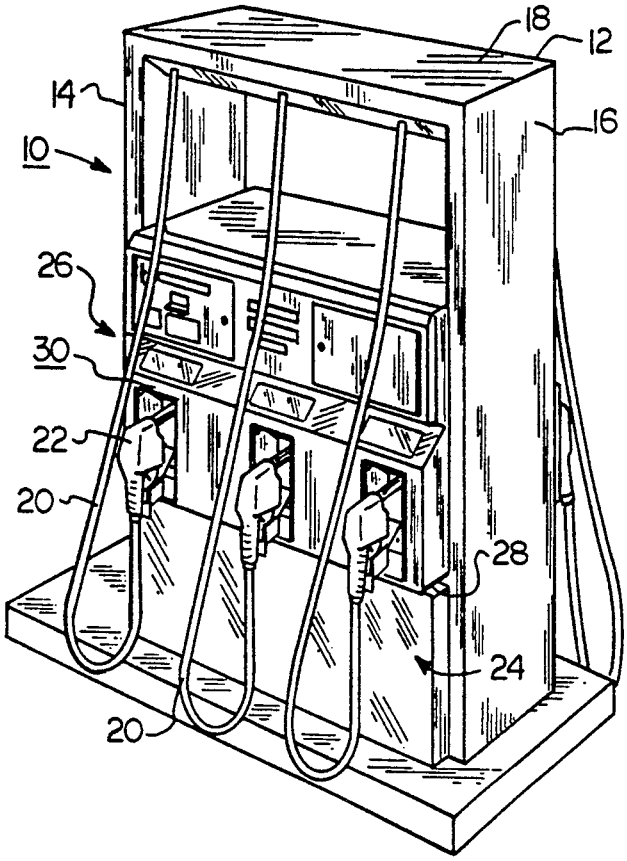
FIG. 1 is a perspective view of a multiple product fuel dispenser of the type incorporating the present invention.

In FIG. 1, there is illustrated one type of multiple product fuel dispenser 10 which incorporates the present invention. As is common in many fuel dispensers, a frame 12 supports sidewalls 14,16 and a top wall 18. In the dispenser 10 illustrated, as is conventional, a plurality of pumps or flow control valves are housed in a hazardous lower zone behind cover 24 and are connected by appropriate conduits to underground tanks. A plurality of further pipes extend from the flow control valves in the lower zone behind cover 24 through the sidewalls 14,16 to a point of connection with the hoses 20 in the upper wall 18. In the illustrated embodiment, each hose 20 is connected to a separate pipe through which is delivered a different type of fuel to a nozzle 22.

In most embodiments, the nozzles 22 are mounted in nozzle boots and cradles which are secured separately to the dispenser frame 12 or to the superstructure of the housing which covers the hazardous zone. The area above the hazardous zone is referred to as the safe zone in which are housed the electronics, electrical devices, lamps, and one or more customer communication devices such as fuel and price indicators, receipt printers, credit card readers, case receipt devices, operator key pads, and the like.

In the present invention, the safe zone access door 30 adopts a "unitized construction". Toward this end, a molded or formed door panel 60 is hinged at one edge to selectively cover and provide access to the entire safe zone in which are housed all the aforementioned electronic devices. At this point, it should be pointed out that the door panel 60 is envisioned as preferably being of a molded polymeric material although a formed metallic construction would also be within the broader scope of the invention. However, as used throughout the remainder of this specification, the term "molded body panel" will include such other constructions. Also, the nozzle boots, cradle clearance wells, and seats for the nozzle cradle mounting plates are formed or molded integrally with the door panel. The molded door panel 60 also includes an upper section 64 that includes one or more cutouts through which certain display indicators of a main dispenser display available and a pair of opposed openings with hinge brackets molded adjacent one edge to receive a pair of smaller access covers. The door panel also includes a peripheral ridge into which is mounted a sealing gasket.

It should also be mentioned here that there is, in the preferred embodiment, an air gap 28 between the lower wall of the safe zone 26 and the upper wall of the hazardous zone 24. This construction is better described and illustrated in applicant's copending application Ser. No. 07/445,466 filed Dec. 4, 1989. It should also be noted here that, while a fuel dispenser 10 of the type having a plurality of nozzles on each side which dispense a separate type of fuel is illustrated, other types of multiple product fuel dispensers are contemplated within the scope of the present invention. Some of the other type of fuel dispensers include those which have only a single hose and nozzle and dispense a blend of gasoline from several pumps which are delivered separately and blended at the nozzle. Still a further type of fuel dispenser housing includes two hose/nozzle units on each side thereof, one of which provides blended fuel and the other provides the most predominant type of fuel to be dispensed. Other combinations of types of nozzles may also be used. However, in all of such situations, as contemplated by the present invention, the safe zone of the dispenser is covered by the unitized access door which will be described hereinafter. It should also be pointed out that in FIG. 1, as is the case in most fuel dispensers, the hose/nozzle arrangement and customer communication devices which appear on one side are duplicated on the opposite side, so that the island serves two vehicles at once.

Figure 2:
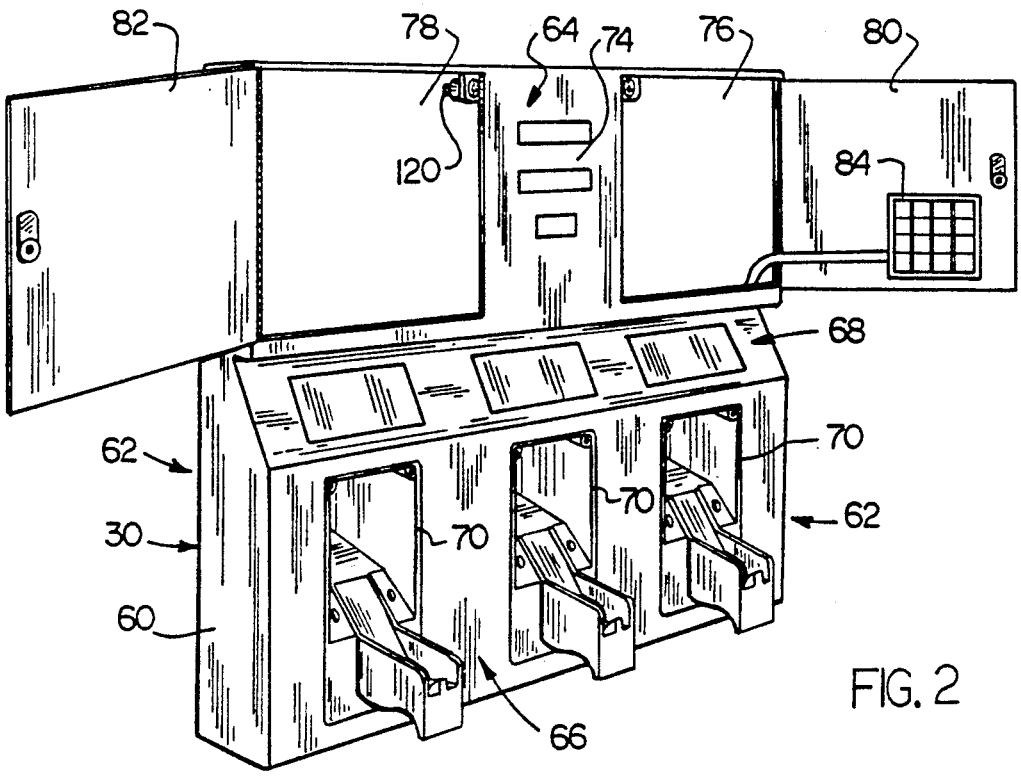
FIG. 2 is an enlarged perspective view of the covered safe zone of the fuel dispenser of FIG. 1 illustrating the small access panels in an open position.

Turning now to FIGS. 2 and 3, there is better illustrated the unitized access door which covers the safe zone 26 and forms the essence of the present invention. Access door 30 is hingedly attached to a safe zone support frame 40. The support frame 40 is attached to the dispenser frame 12 between sidewalls 14,16 and is formed of two sidewalls 42,44, a top wall 46, a bottom wall 48, and an intermediate shelf 50.

The unitized access door 30 preferably comprises a molded, polymeric panel 60. Preferably, the panel 60 is molded of low pressure structural foam materials such as a glass-filled polycarbonate/polybutylene terephthalate. The polycarbonate may also be blended with other polymers such as polypropylene. Additionally, it should be recognized that the door panel could also be molded or formed of other materials such as metals or ceramics. The door panel 60 includes a main body portion 62 having upper section 64, lower section 66, and intermediate section 68. One or more nozzle boots 70 are molded integrally into the surface of the lower section 66 as will be more fully described hereinafter with reference to FIGS. 5-7.

The intermediate section 68 includes an inclined surface that tapers rearwardly and upwardly from the front surface of lower section 66 to a point beneath the lower edge of upper section 64. Intermediate section 68 includes, for example, one or more fuel description panels which describe the type of fuel being dispensed from the nozzle mounted therebelow and the unit price of each type of fuel. Generally, the unit price indicators may be changed by an operator's electronics keypad to be described hereinafter, and comprise some type of displays which are mounted to the slots rear of the intermediate section behind corresponding electronics keypad to be described hereinafter, and comprise some type of displays which are mounted to the slots rear of the intermediate section behind corresponding slots therein.

The upper portion 64 of the main body portion 62 includes an appropriate flourescent light fixture 75 attached to the rear surface thereof. A slotted opening 77 between the lower edge of upper section 64 and the upper edge of intermediate section 68 provides a path for light rays from the flourescent tube to illuminate the descriptive panels described hereinabove. Also the upper section 64 includes a main dispenser display panel 74 located approximately in the middle of the upper portion between two relatively large openings 76,78. The main dispenser display unit (not shown) is attached to the rear surface of the display panel 74 and provides displays which are visible through one or more openings therein and indicate the type, volume, and price, on a continuing basis, of the fuel being dispensed at the present time.

Two smaller access panels 80,82 are hingedly attached to the door panel 60 to selectively open and close the access openings 76,78. Corresponding hinge structures are molded into the door panel 62 and into one edge of each of the access panels 80,82. The right access door 80 has two functions. One function is to support, on the rear surface thereof an operator electronics keypad 84. The other function is to provide access to the interior compartment therebehind. In some cases, one of the options of the fuel dispenser 10 is the ability to accept cash in the form of bills. In such cases, the compartment will contain a cash validation device and a cash storage box. Access to the cash validation device will be through the left-hand panel 84 of the other side of the dispenser. However, the operator can remove bills and notes from the rear side of the cash receipt and storage container through the right-hand access door 80 of the front side of the dispenser 10.

The second or left access door 82 is also selectively provided with openings and slots therein to permit access to and control of various electrical devices which may be provided according to the customers option. For example, in addition to the note or cash receipt device, there may be provided other customer communication devices such as a receipt printer, a credit card reader, and a customer key pad and prompter. The prompter and key pad indicate to the service station customer the manner in which the electronic devices included therein are to be operated, and also indicate to the customer the procedure to obtain his fuel.

In recent years, for security reasons, it has become desirable to isolate the service station operator from the customer as much as possible. With modern fuel dispensers, the customer may pump his own gas, and pay his own bills with either cash or credit cards. He may also even receive a receipt. All this may be accomplished without ever requiring that the customer enter the service station office. This tends to protect the operator and provide more security. While the present invention is not directed to the provision of any of these electronic devices, it is directed to a unitized access door for fuel dispensers of the types which contain such equipment.

Figure 5:
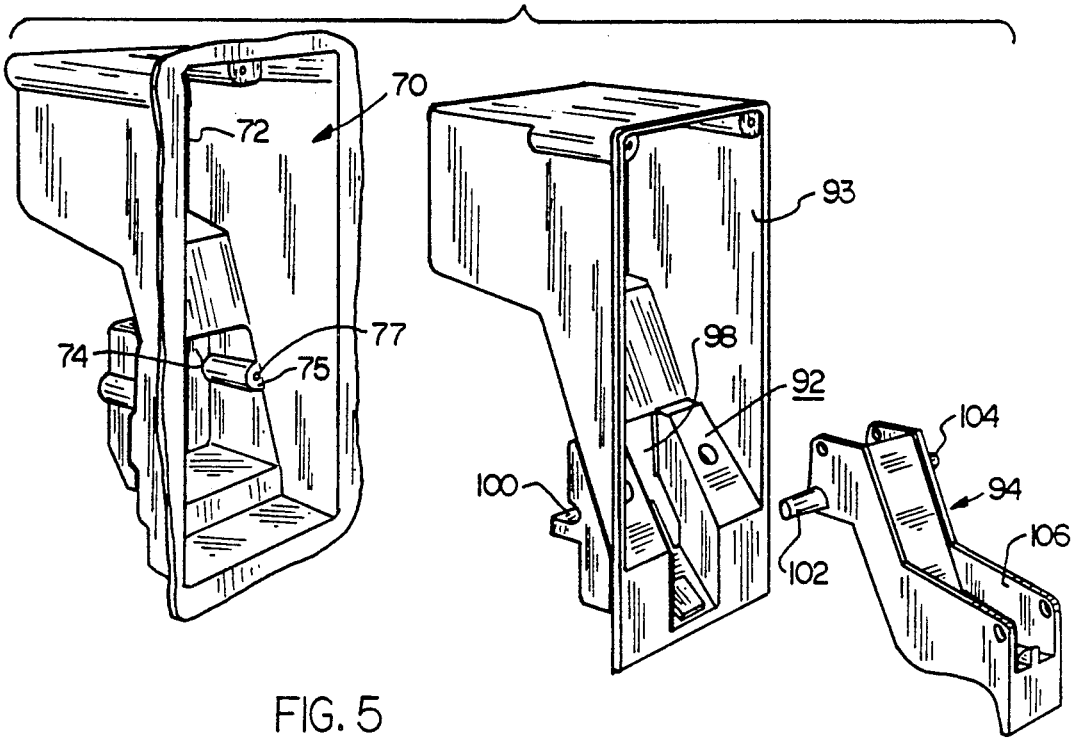
FIG. 5 is an enlarged exploded perspective view of a portion of the unitized access door illustrating a single molded nozzle boot with the corresponding nozzle mounting plate, base, and cradle.
Figure 6:
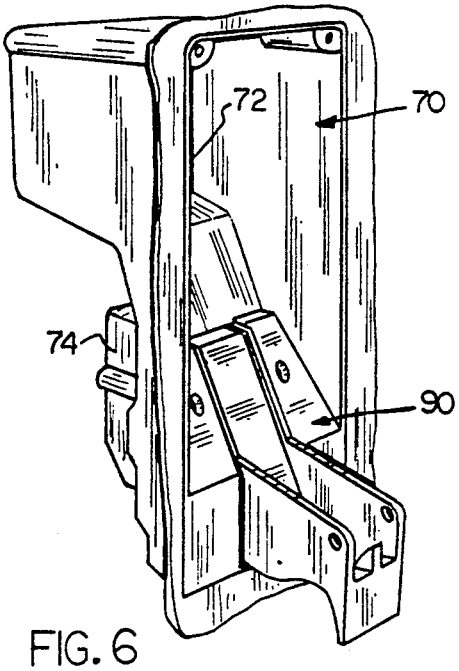
FIG. 6 is a perspective view similar to FIG. 5 except illustrating the nozzle cradle installed and in the off or down position.
Figure 7:
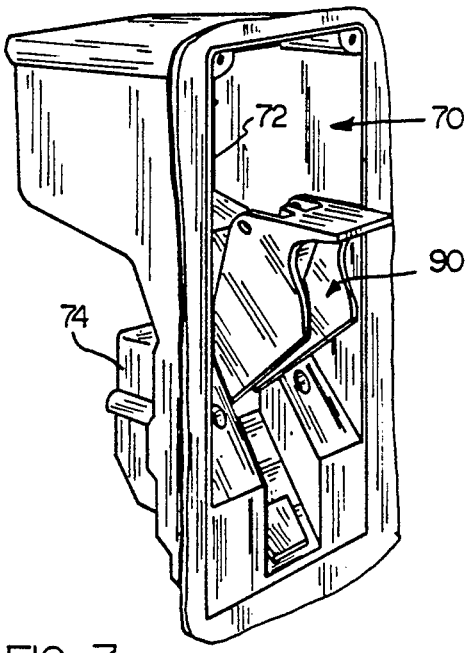
FIG. 7 is a perspective view similar to FIG. 6 except showing the cradle in the on or upper positions.

Turning now to FIGS. 5–7, there is illustrated in FIG. 5 an exploded view of a single nozzle boot 70 and the cradle assembly 90 which is attached thereto. By way of explanation, since the nozzle boot is, in the present invention, located in a position overlying the safe zone, then care must be taken to isolate the exterior of the nozzle boot from the area therebehind. Toward this end, the nozzle boots 70 of the present invention are molded integrally into the surface of the door and, therefore, there is always an air and fluid impermeable wall between the nozzle and the safe zone or compartment therebehind.

Looking now at the boot 70 itself, and with reference to FIG. 5, boot 70 includes an upper well which extends rearwardly from the door a distance of several inches. The upper well 72 includes side walls, a top wall, a bottom wall, and a rear wall.

A second lower well 74 is molded into the boot area beneath the upper boot well 72. The lower well, in general, provides a space for the rotation of the upper end of the cradle to be described hereinafter. The lower well 74 is narrower than the upper well, and therefore provides a pair of side ledges 75. A threaded opening 77 is provided in each side ledge 76 for attaching a separate nozzle cradle mounting plate 92 thereto by means of a pair of threaded fasteners.

The cradle assembly 90 is illustrated in exploded form in FIG. 5 and includes generally three components; first, a nozzle cradle seat 92, a nozzle cradle base 94 and a nozzle cradle 96. The nozzle cradle seat 92 is, itself, a formed metallic unit and preferably includes a protective shield 93 that extends upwardly and rearwardly therefrom to cover the polymeric surface of the upper well 72 and remainder of the boot 70. This shield 93 protects the boot and upper well from damage as a results of impacts from the nozzle and from chemical damage due to dripping of fuel and cleaning agents. The nozzle cradle seat 92 includes a vertically extending groove 98 therein for operatively receiving the nozzle cradle base 94 and 96 therein. The nozzle cradle seat 92 also includes a pair of rearwardly extending fingers 100 which form a seat for laterally extending pins which are molded integrally with or attached to the nozzle cradle 94.

Nozzle cradle 94 provides the means for pivotally mounting the nozzle cradle 96 to the nozzle cradle seat 92. For this purpose, a pair of laterally extending pins 102,104 are provided. The nozzle cradle 94 includes a seat portion 106 in which the handle of the nozzle rests when in the inoperative position. To assemble the nozzle cradle assembly 90 to the nozzle boot 70, cradle 96 is seated in fingers 100. The nozzle cradle seat 92 is then secured to the nozzle cradle seat 76 by means of threaded fasteners as described hereinabove. If desired, in order to assemble the nozzle cradle 94 through groove 98, it may be necessary to form the cradle 94 as two separate pieces (not shown). The upper piece is placed through groove 98, the pins 102,104 seated in seat 100, and then the two pieces of the cradle are secured together.

In operation then, as illustrated in FIGS. 6 and 7, the fuel dispenser nozzle 22 rests in the cradle with the opening in the nozzle in the boot well 72. When the nozzle 22 is removed, the dispenser is activated by lifting the cradle 96 to the position illustrated in FIG. 7. The lower well 74 allows the upper end of the nozzle cradle to pivot around the pivot point formed where the pins 102 rest in seat 100. The well 74 also provides a mounting seat for the electronic switching apparatus (not shown) which then indicates to the fuel dispenser 10 that the selected nozzle is ready for operation. Upon completion of the fuel dispensing operation, the cradle assembly 90 is returned to the position shown in FIG. 6 and the nozzle is returned to the seat 106.

Because of the present invention, the earlier mentioned problems of isolating the exterior of the nozzle boots from the electronics compartment in the safe zone therebehind are eliminated. Further, there is no need for sealing of the nozzle boots to a frame or housing, because the boots are molded integrally into the face of the unitized access door 30.

Figure 8A:
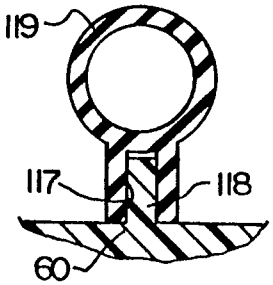
FIG. 8*a* is a sectional view taken substantially along lines 8*a*—8*a* in FIG. 8.
Figure 8:
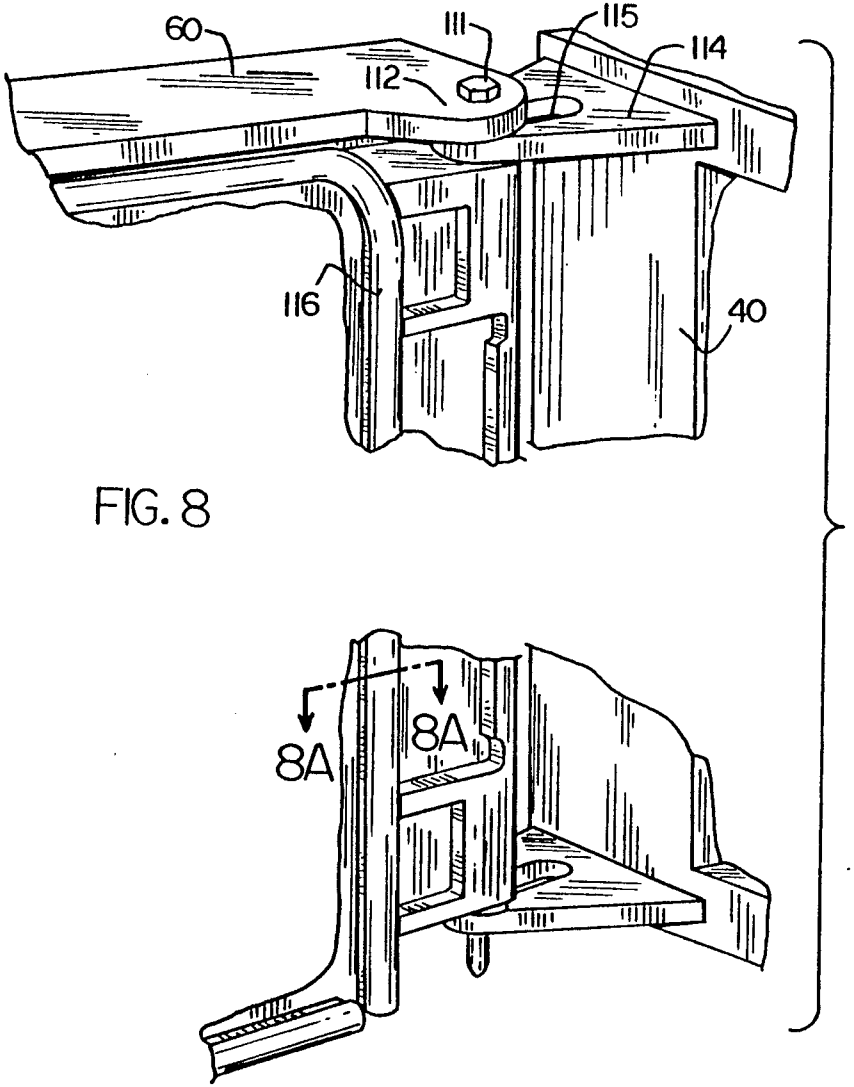
FIG. 8 is an enlarged perspective view of one side of the unitized door construction, illustrating the unique door hinge contemplated for use with the present invention.

Turning now to FIG. 8, there is illustrated a unique sealing arrangement for the unitized access door. First of all, it is desired that the access door 30 present a pleasing appearance with respect to the fuel dispenser housing. Toward this end, it is desired to eliminate exposed hinge pins and the like. Therefore, a hinging arrangement is sought whereby the hinge is concealed behind the rear surface of the access door 30. This presents somewhat of a problem because, in such an arrangement, the mere pivotal movement of the door will not return the door to a position close enough to the face of the mounting frame 40 therebehind to provide a sealed relationship. Therefore, the concept of the hinging arrangement is that there is provided the ability for the door to be swung about a vertical pivot axis, and then moved rearwardly, once the door is swung to the approximate closed position.

This is accomplished by providing a hinging arrangement at the top and bottom of the side edge of the door in which a hinge pin 110 is secured to a hinge support bracket 112 which was previously molded into the rear surface of the access door panel 60. A complementary hinge pin receiving bracket 114 extends outwardly from the front face of the side wall 44 or top wall 46 of the compartment frame 40. The receiving bracket 114 includes a slotted opening therein that is elongated in a direction toward and away from the front surface of compartment frame 40. So arranged, when the door is pivotted to a closed position, it can then be moved laterally toward or away from the support frame.

A complementary gasket 116 is attached to a ridge 118 which extends around the periphery of the rear side of door panel 60. A cross-section of the gasket is best illustrated in FIG. 8*a*. The grooved portion 117 of the gasket receives ridge 118. A circular portion 119 of the gasket is compressed and mashed as the door is moved toward the support frame 40. In moving the door toward the support frame 40, as explained hereinbefore, a plurality of locking pins 120 are utilized in conjunction with complementary mounting holes 122 which together form a latching means along the lower edge of top wall 46 and the upper edge of bottom wall 48 of compartment frame 40.

As an added security measure, the pins 120 which extend into the mounting openings 122 along the top wall 46 are not accessible ordinarily. In order to gain access to such locking pins, access doors must be unlocked and open. Therefore, the operator is the only person who can gain access to the uppermost locking pins 120. As such, this prevents unauthorized access to the interior of the electronics compartment.

While a preferred embodiment of the present invention has been described in detail hereinabove, it is apparent that various changes and modifications might be made to the unitized access door and, more particularly, to the arrangement of components thereon. The scope of the invention is therefore set forth in the accompanying claims.

What is claimed is:

1. A unitized access door for fuel dispenser islands of the type formed by a frame which defines a first enclosure referred to as a safe zone which houses electrical devices, circuits, lamps, and one or more customer communication devices such as fuel and price indicators, receipt printer, credit card reader, cash receipt device, operator key pad, and the like, and a second enclosure referred to as the hazardous zone, said access door extending across an open side of said first enclosure and comprising:

a) a body panel having a front surface, rear surface, top edge, bottom edge, and a pair of opposed side edges, the dimensions defined by said top edge, bottom edge, and side edges being such as to entirely cover said open side of said first enclosure;

b) one of said edges containing hinge means cooperating with said frame for mounting said body panel latching means associated with at least one of the other of said side edges and cooperating with said frame for maintaining said body panel in the closed position, whereby the access door swings outwardly about an axis extending along said one side to provide unrestricted access to all of the electronics therebehind; and c) at least one nozzle boot formed integrally into said access door, said nozzle boot comprising a nozzle receiving well extending into the surface from the front thereof and protruding rearwardly from the rear surface.

2. The access door according to claim 1 wherein the portion of said body panel, which includes said nozzle boot, covers at least some of said electrical devices therebehind.

3. The access door according to claim 1 and further wherein each of said nozzle boots includes a lower cradle clearance well formed into the surface of said body panel at a point spaced from and beneath said nozzle receiving well.

4. The access door according to claim 3 wherein said nozzle boot, including said nozzle receiving well and lower cradle clearance well, comprise side walls, top walls, lower walls, and rear walls which are air and fluid impermeable to isolate the exterior of the nozzle boot from the safe zone therebehind.

5. The access door according to claim 3 wherein said cradle clearance well includes flanged front portions which form a seat for a cradle assembly.

6. The access door according to claim 1 wherein said body panel is molded form a polymeric material and said nozzle boot includes an opening in the front surface of said molded body panel, said opening being closed by said nozzle receiving well which extends rearwardly from the rear surface of said molded panel and includes molded integrally therewith a top wall, side walls, a bottom wall and a rear wall; and said nozzle both further comprising a lower cradle clearance well which protrudes rearwardly from the rear surface of said molded body panel and includes molded integrally therewith a top wall, side walls, a bottom wall, and a rear wall; said side walls of the nozzle well including outwardly extending flanges which connect the side walls of the nozzle boot to form a nozzle cradle seat, and further wherein at least said nozzle well includes a metallic liner secured to the exposed surface thereof to protect the boot from damage resulting from impacts and chemicals.

7. The access door according to claim 5 wherein a nozzle cradle mounting plate is secured to said nozzle cradle seat and pivotally supports a cradle thereon, said pivotal cradle having an upper end and a lower end, said upper end extending into said cradle clearance well which provides clearance for the upper end of said cradle during its pivotal movement.

8. The access door according to claim 1 wherein said body panel includes a ridge extending rearwardly therefrom substantially around the periphery thereof and a seal comprising a tubular member having a pair of spaced, longitudinally extending flanges, said tubular sealing member being received on said peripheral ridge within the space between said flanges, whereby said tubular portion is urged against the face of said frame which forms said first enclosure to effect the seal therearound.

9. The access door according to claim 1 wherein said hinge means comprises a pair of spaced brackets along said one edge which extend rearwardly of said access door, a hinge pin extending longitudinally of said one edge from each of said mounting brackets, and a support bracket extending forwardly from a wall of said first enclosure, each of said support brackets including an elongated opening therein for receiving one of said pins, whereby to close said access door, said door is first pivoted about said mounting pin, and then forced rearwardly within said elongated opening to effect the seal against said enclosure.

10. The access door according to claim 8 wherein said latching means comprises a plurality of latch pin/-bolt receiving brackets positioned at spaced intervals along one of the walls of said first enclosure adjacent the other edge of said access door, and a plurality of fastener pins extending through said access door and aligned with said pin receiving brackets, whereby said sealing of said access door is affected by tightening said fastener pins within said pin receiving brackets.

11. A multiple product fuel dispenser providing easier access for maintenance, management, and operation, said fuel dispenser comprising:

a) a housing having:

i) a first upper enclosure constituting a safe zone in which are housed electronics, electrical devices, lamps, and one or more customer communication devices such as fuel and price indicators, receipt printer, credit card reader, cash note accepter and storage, operator key pad, and the like;

ii) a second lower enclosure constituting a hazardous zone in which are housed fuel pumps, or flow control valves, at least one filter, and gasoline conduits connecting underground tanks and dispenser hoses;

iii) said first and second enclosures being isolated from each other;

b) a unitized access door for each side of said first enclosure comprising:

i) a body panel having a front surface, rear surface, top edge, bottom edge, and a pair of opposed side edges, the dimensions defined by said top edge, bottom edge, and side edges being such as to entirely cover open side of said first enclosure;

ii) one of said side edges containing hinge means cooperating with said first enclosure for mounting said body panel, latching means associated with at least one of the other of said side edges and cooperating with said frame for maintaining said body panel in the closed position, whereby the access door swings outwardly about an axis extending along said one side edge to provide unrestricted access to all of the electronics therebehind; and iii) at least one nozzle boot formed integrally into said access door, said nozzle boot comprising a nozzle receiving well extending into the surface from the front thereof and protruding rearwardly from the rear surface.

12. The fuel dispenser according to claim 11 wherein the portion of said body panel, which includes said nozzle boot, covers at least some of said electrical devices therebehind.

13. The fuel dispenser according to claim 11 and further wherein each of said nozzle boots includes a lower cradle clearance well formed into the surface of said body panel at a point spaced from and beneath said nozzle receiving well.

14. The fuel dispenser according to claim 13 wherein said nozzle boot, including said nozzle well and lower cradle clearance well, comprises side walls, top walls, lower walls, and rear walls which are air and fluid impermeable to isolate the exterior of the nozzle boot area from the safe zone therebehind.

15. The fuel dispenser according to claim 13 wherein said cradle clearance well includes flanged front portions which form a seat for a cradle assembly.

16. The fuel dispenser according to claim 11 wherein said body panel is molded from a polymeric material and said nozzle boot includes an opening in the front surface of said molded body panel, said opening being closed by said nozzle well which extends rearwardly from the rear surface of said molded panel and includes molded integrally therewith a top wall, side walls, a bottom wall, and a rear wall; and a lower cradle clearance well which protrudes rearwardly from the rear surface of said molded body panel and includes molded integrally therewith a top wall, side walls, a bottom wall, and a rear wall; said side walls of the nozzle receiving well including outwardly extending flanges which connect the side walls of the cradle clearance well with the side walls of the nozzle boot to form a nozzle cradle seat, and further wherein at least said nozzle well includes a metallic liner secured to the exposed surface thereof to protect the boot from damages resulting from impact and chemicals.

17. The fuel dispenser according to claim 15 wherein a nozzle cradle mounting plate is secured to said nozzle cradle seat and pivotally supports a cradle thereon, said pivotal cradle having an upper end and a lower end, said upper end extending into said cradle clearance well which provides clearance for the upper end of said cradle during its pivotal movement.

18. The fuel dispenser according to claim 11 wherein said body panel includes a ridge extending rearwardly therefrom substantially around the periphery thereof and a seal comprising a tubular member having a pair of spaced, longitudinally extending flanges, said tubular sealing member being received on said peripheral ridge within the space between said flanges, whereby said tubular portion is urged against the face of said housing which forms said first enclosure to effect the seal therearound.

19. The fuel dispenser according to claim 11 wherein said hinge means comprises a pair of spaced brackets along said one edge which extend rearwardly of said access door, a hinge pin extending longitudinally of said one edge from each of said mounting brackets, and a support bracket extending forwardly from a wall of said first enclosure, each of said support brackets including an elongated opening therein for receiving one of said pins, whereby to close said access door, said door is first pivoted about said mounting pin, and then forced rearwardly within said elongated opening to effect the seal against said enclosure.

20. The fuel dispenser island according to claim 18 wherein said latching means comprises a plurality of latch pin/bolt receiving brackets positioned at spaced intervals along one of the walls of said first enclosure adjacent the other edge of said access door, and a plurality of fastener pins extending through said access door and aligned with said pin receiving brackets, whereby said sealing of said access door is affected by tightening said fastener pins within said pin receiving brackets.

21. A unitized nozzle boot housing for the access door of fuel dispenser islands of the type wherein said nozzle boot is formed integrally into said access door, said nozzle boot construction comprising:

a) a nozzle well extended into the surface of said access door from the front thereof and protruding from the rear surface;

b) a lower cradle clearance well molded into the surface of said access door at a point spaced from and beneath said nozzle well.

22. The nozzle boot housing of claim 21 wherein said nozzle boot, including said nozzle well and lower cradle clearance well, comprises side walls, top walls, lower walls, and rear walls which are air and fluid impermeable to isolate the exterior of the nozzle boot from the safe zone therebehind.

23. The nozzle boot housing according to claim 21 wherein said cradle clearance well includes flanged front portions which form a seat for a cradle assembly.

24. The nozzle boot housing according to claim 21 wherein said nozzle boot includes an opening in the front surface of said access door, said opening being closed by said nozzle well which extends rearwardly from the rear surface of said access door and includes molded integrally therewith a top wall, side walls, a bottom wall, and a rear wall; and a lower cradle clearance well which protrudes rearwardly from the rear surface of sad molded body panel and includes molded integrally therewith a top wall, side walls, a bottom wall, and a rear wall; said side walls of the nozzle well including outwardly extending flanges which connect the side walls of the cradle clearance well with the side walls of the nozzle boot to form a nozzle cradle seat, and further wherein at least said nozzle well includes a metallic liner secured to the exposed surface thereof to protect the boot from damages resulting from impacts and chemicals.

* * * * *